US010280496B2

(12) United States Patent
Yeh et al.

(10) Patent No.: US 10,280,496 B2
(45) Date of Patent: May 7, 2019

(54) LIGHT MAGNESIUM ALLOY AND METHOD FOR FORMING THE SAME

(71) Applicant: AMLI MATERIALS TECHNOLOGY CO., LTD., Taoyuan (TW)

(72) Inventors: Ming-Tarng Yeh, New Taipei (TW); Wen-Shiang Chen, New Taipei (TW)

(73) Assignee: AMLI MATERIALS TECHNOLOGY CO., LTD., Taoyuan (TW)

( * ) Notice: Subject to any disclaimer, the term of this patent is extended or adjusted under 35 U.S.C. 154(b) by 234 days.

(21) Appl. No.: 15/266,609

(22) Filed: Sep. 15, 2016

(65) Prior Publication Data

US 2017/0198377 A1 Jul. 13, 2017

(30) Foreign Application Priority Data

Jan. 7, 2016 (TW) ..... 105100403 A

(51) Int. Cl.
*C22F 1/06* (2006.01)
*C22C 23/00* (2006.01)

(52) U.S. Cl.
CPC ..... *C22F 1/06* (2013.01); *C22C 23/00* (2013.01)

(58) Field of Classification Search
CPC . C22F 1/06; C22C 23/00; C22C 23/02; C22C 23/04
See application file for complete search history.

(56) References Cited

U.S. PATENT DOCUMENTS

| | | | | |
|---|---|---|---|---|
| 3,119,689 | A * | 1/1964 | Saia | C22C 23/00 148/406 |
| 4,130,500 | A | 12/1978 | Melendres et al. | |
| 5,059,390 | A * | 10/1991 | Burleigh | C22C 23/00 420/405 |
| 6,694,039 | B1 | 2/2004 | Wu | |
| 2004/0241036 | A1 | 12/2004 | Meyer-Lindenberg et al. | |

FOREIGN PATENT DOCUMENTS

| | | | |
|---|---|---|---|
| CN | 1583322 | A | 2/2005 |
| CN | 1605650 | A | 4/2005 |
| CN | 1876872 | A | 12/2006 |
| CN | 1924055 | A | 3/2007 |
| CN | 101067200 | A | 11/2007 |
| CN | 101121981 | A | 2/2008 |
| CN | 101245455 | A | 8/2008 |
| CN | 101245485 | A | 8/2008 |
| CN | 100482834 | C | 4/2009 |
| CN | 101921922 | A | 12/2010 |
| CN | 101928845 | A | 12/2010 |
| CN | 102618764 | A | 8/2012 |
| CN | 102676894 | A | 9/2012 |
| CN | 102753714 | A | 10/2012 |
| CN | 102791402 | A | 11/2012 |
| CN | 103031474 | A | 4/2013 |
| CN | 103184378 | A | 7/2013 |
| CN | 103189154 | A | 7/2013 |
| CN | 103290286 | * | 9/2013 |
| CN | 104004950 | A | 8/2014 |
| CN | 104498793 | * | 4/2015 |
| CN | 104498793 | A | 4/2015 |
| JP | S58161495 | A | 9/1983 |
| JP | H06-316750 | A | 11/1994 |
| JP | 2012021182 | A | 2/2012 |
| JP | 2012130957 | A | 7/2012 |
| TW | 574376 | B | 2/2004 |
| TW | M252487 | U | 12/2004 |
| TW | M267781 | U | 6/2005 |
| TW | I235182 | B | 7/2005 |
| TW | I253869 | B | 4/2006 |
| TW | 200618882 | A | 6/2006 |
| TW | I284153 | B | 7/2007 |
| TW | 200824832 | A | 6/2008 |
| TW | 201041670 | A | 12/2010 |
| TW | 201042084 | A | 12/2010 |
| TW | 201043708 | A | 12/2010 |
| TW | 201103659 | A | 2/2011 |
| TW | 201103660 | A | 2/2011 |
| TW | 201120243 | A | 6/2011 |
| TW | 201120248 | A | 6/2011 |
| TW | 201124541 | A | 7/2011 |
| TW | I357931 | B | 2/2012 |
| WO | WO-9604409 | A1 | 2/1996 |

OTHER PUBLICATIONS

Cheng Li Ren (Jilin University) "Investigation on Microstructure and Mechanical Properties of As-cast, Extruded and Semisolid Mg—Li—Al Magnesium Alloys" 2011; Published by CNKI (ISSN 1674-022X CN 11-9133/G); English abstract.

Libin Wu et al, Effects of Ce-rich RE additions and heat treatment on the micorstructure and tensile properties of Mg—Li—Al—Zn-based alloy, Materals Science and Engineering A, 2011, 528, 2174-2179.

Jiqing Li et al, Effects of Cu addition on the microstructure and hardness of Mg—5Li—3Al—2Zn alloy, Materials Science and Engineering A, 2010, 527, 10-11, 2780-2783.

Zhikun Qu, Microstructure and corrosion resistance of three typical superlight Mg—Li alloys, International Journal of Materials Research, 2014.

(Continued)

*Primary Examiner* — C Melissa Koslow

(74) *Attorney, Agent, or Firm* — Rabin & Berdo, P.C.

(57) ABSTRACT

A magnesium alloy includes Mg, 1 to 12 wt % of Li, 1 to 10 wt % of Al and 0.2 to 3 wt % of Zn. The magnesium alloy has a microstructure which includes a nanoscale reinforcement phase, wherein the nanoscale reinforcement phase is a Li—Al compound.

14 Claims, 6 Drawing Sheets

(56) References Cited

OTHER PUBLICATIONS

Taiwanese Office Action dated Mar. 23, 2016.
Shih-Chao Lin et al., "Study on Mechanical Properties and Aging Strengthening of LAZ661 Alloy", http://www.yoke.net/chinese/main.asp?url=052&cid=174&fyear=0&pageno=3, Jul. 22, 2015.
Zhikun Qu et al., "The solution and room temperature aging behavior of Mg—9Li—xAl(x=3,6) alloys" Journal of Alloys and Compounds, NL, vol. 536, pp. 145-149, Sep. 25, 2012.
Tetsuya Sakai et al., "Semi-solid forming of Mg—Li—Al—Ca light metal alloys", Journal of Japan Institute of Light Metals, vol. 48, No. 1, pp. 13-18, Jan. 1998.
Japanese Office Action dated Nov. 1, 2016.
Chinese Office Action dated Mar. 29, 2017.
Japanese Office Action dated May 30, 2017.
U.S. Office Action dated Jun. 27, 2017 for related U.S. Appl. No. 14/882,433.
Meng-Chang Lin et al, "Preparation of Mg—Li—Al—Zn Master Alloy in Air by Electrolytic Diffusing Method", Materials Transactions, vol. 46, No. 6 (2005) pp. 1354-1359, 2005.
U.S. Office Action dated May 25, 2018 for U.S. Appl. No. 14/882,433.

* cited by examiner

LIGHT MAGNESIUM ALLOY AND METHOD FOR FORMING THE SAME

This application claims the benefit of Taiwan application Serial No. 105100403, filed on Jan. 7, 2016, the disclosure of which is incorporated by reference herein in its entirety.

TECHNICAL FIELD

The disclosure relates to an alloy and a method for manufacturing the same, and particularly to a magnesium alloy and a method for manufacturing the same.

BACKGROUND

High specific strength (i.e. the value of the strength of a material divided by its density) is a requirement of a metal material. The magnesium alloy has a low density, and thereby intrinsically provides a higher specific strength. Therefore, it is desired to further improve the strength and decrease the density of a magnesium alloy.

SUMMARY

According to some embodiments, a magnesium alloy is provided. The magnesium alloy includes magnesium (Mg), 1 to 12 wt % of lithium (Li), 1 to 10 wt % of aluminum (Al), and 0.2 to 3 wt % of zinc (Zn). The magnesium alloy has a microstructure which include a nanoscale reinforcement phase, and the nanoscale reinforcement phase is a Li—Al compound.

According to some embodiments, a method for manufacturing a magnesium alloy is provided. The method includes following steps. First, a magnesium alloy is formed by casting, wherein the magnesium alloy includes magnesium (Mg), 1 to 12 wt % of lithium (Li), 1 to 10 wt % of aluminum (Al), and 0.2 to 3 wt % of zinc (Zn). Then, a series of thermo-mechanical treatments are performed on the magnesium alloy to form a nanoscale reinforcement phase on the magnesium alloy, wherein the nanoscale reinforcement phase is a Li—Al compound.

Figure 1:
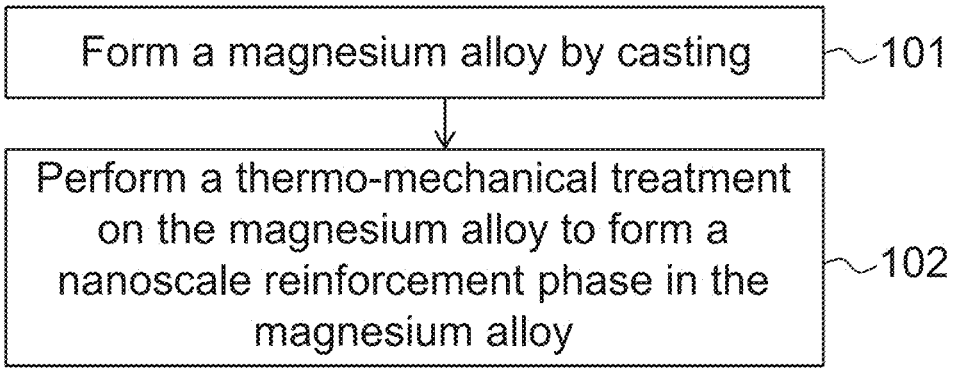
FIG. 1 shows a flowchart of a method for manufacturing a magnesium alloy according to embodiments.

In the following detailed description, for purposes of explanation, numerous specific details are set forth in order to provide a thorough understanding of the disclosed embodiments. It will be apparent, however, that one or more embodiments may be practiced without these specific details.

In other instances, well-known structures and devices are schematically shown in order to simplify the drawing.

DETAILED DESCRIPTION

The disclosure relates to a magnesium alloy and a method for manufacturing the same. Through the reinforcement phase existing in the microstructure, properties of the magnesium alloy, such as the strength of the magnesium alloy, can be further enhanced. The magnesium alloy includes magnesium (Mg), 1 to 12 wt % of lithium (Li), 1 to 10 wt % of aluminum (Al), and 0.2 to 3 wt % of zinc (Zn). The microstructure of the magnesium alloy includes a nanoscale reinforcement phase, which is a Li—Al compound.

Magnesium is the main element of the magnesium alloy. That is, other than the compositions indicated in the disclosure, the remaining portion of the magnesium alloy is provided by magnesium. Using magnesium as the main element makes the magnesium alloy possess lightweight. The addition of lithium to the magnesium alloy can increase heat treatability and reduce the density of the magnesium alloy. The addition of aluminum, particularly under the conditions of solid solution, can increase the strength of the magnesium alloy at a room temperature. The addition of a small amount of zinc can improve the corrosion resistance of the magnesium alloy. In one embodiment, the magnesium alloy may include magnesium (Mg), 4 to 12 wt % of lithium (Li), 4 to 9 wt % of aluminum (Al), and 0.2 to 3 wt % of zinc (Zn). According to one embodiment, The magnesium alloy may further include other compositions, such as ≤0.3 wt % of manganese (Mn) and ≤0.2 wt % of silicon (Si). The addition of a small amount of manganese can improve the corrosion resistance of the magnesium alloy. The addition of a small amount of silicon can improve the strength of the magnesium alloy.

The properties of the magnesium alloy can be improved through suitably adjusting the structure of a nanoscale reinforcement phase as disclosed herein. For example, given that the nanoscale reinforcement phase exists, the yield strength can be increased by about 5 to 150%. Besides, a higher level of hardness can be achieved if the nanoscale reinforcement phase has a suitable size.

Specifically, the nanoscale reinforcement phase may include a plurality of particle structures and/or a plurality of rod structures. In one embodiment, the particle structures have a diameter of 3 to 900 nm. In one embodiment, the particle structures have a diameter of 3 to 500 nm. In one embodiment, the particle structures have a diameter of 3 to 20 nm. In one embodiment, the rod structures have a diameter of 15 to 70 nm and a length of 500 to 2,000 nm. In one embodiment, the rod structures have a diameter of 50 to 150 nm and a length of 1,500 to 3,300 nm. In one embodiment, the rod structures have a diameter of 100 to 700 nm and a length of 2,500 to 10,000 nm. In one embodiment, the rod structures have a diameter of 3 to 15 nm and a length of 60,000 to 150,000 nm.

In some embodiments, in addition to the Li—Al compound as described above, the magnesium alloy may further include at least another nanoscale reinforcement phase, which is selected from a group composed of: Mg—Li compound, Mg—Al compound (such as $Mg_{17}A1_{12}$ phase), and Mg—Li—Al compound (such as $MgLi_2A1$ phase). In some embodiments, a small amount of other elements may solidly dissolve in the Li—Al compound and these compounds. Here, a "compound" may also be referred as a "phase".

Embodiments of a method for manufacturing a magnesium alloy are described below. However, the embodiments are for explanatory and exemplary purposes only, not for limiting the scope of the invention. Referring to FIG. 1, a flowchart of a method for manufacturing a magnesium alloy according to embodiments is shown. In the step 101, a magnesium alloy is formed by casting. The magnesium alloy may have any one of the composition proportions as described above. For example, the magnesium alloy may include magnesium (Mg), 1 to 12 wt % of lithium (Li), 1 to 10 wt % of aluminum (Al), and 0.2 to 3 wt % of zinc (Zn). In the step 102, a thermo-mechanical treatment is performed on the magnesium alloy to from a desired nanoscale reinforcement phase in the magnesium alloy. The nanoscale reinforcement phase at least includes a lithium-aluminum phase, and may also include other types of nanoscale reinforcement phase, such as a Mg—Li phase, a Mg—Al phase, and/or a Mg—Li—Al phase.

Specifically, the thermo-mechanical treatment can be selected from at least one of: a solid solution treatment, a homogenization treatment, an aging treatment, a T5 heat treatment, a T6 heat treatment, a thixomolding treatment, a semi-solid metal casting treatment, an extrusion treatment, a forging treatment, and a rolling treatment. In one embodiment, the thermo-mechanical treatment includes a solid solution treatment and an aging treatment. In one embodiment, the thermo-mechanical treatment includes performing an aging treatment at 30 to 350° C. for 0.1 to 350 hr. In one embodiment, the thermo-mechanical treatment includes a thixomolding treatment.

Through the thermo-mechanical treatment, the nanoscale reinforcement phase can be formed and/or adjusted. In particular, the size of the nanoscale reinforcement phase can be adjusted. As such, the magnesium alloy can have better properties. In some experimental examples, the magnesium alloy obtained from the step 101 can have a yield strength of about 150 MPa. After the step 102 (such as a rolling treatment or a thixomolding treatment, the yield strength can further be increased to over 300 MPa.

A number of experimental examples of the magnesium alloy having nanoscale reinforcement phase are provided below. The exemplary magnesium alloy includes magnesium (Mg), 7 wt % of lithium (Li), 7 wt % of aluminum (Al), and 1 wt % of zinc (Zn), and is referred as ALZ771 hereinafter.

Figure 2A:
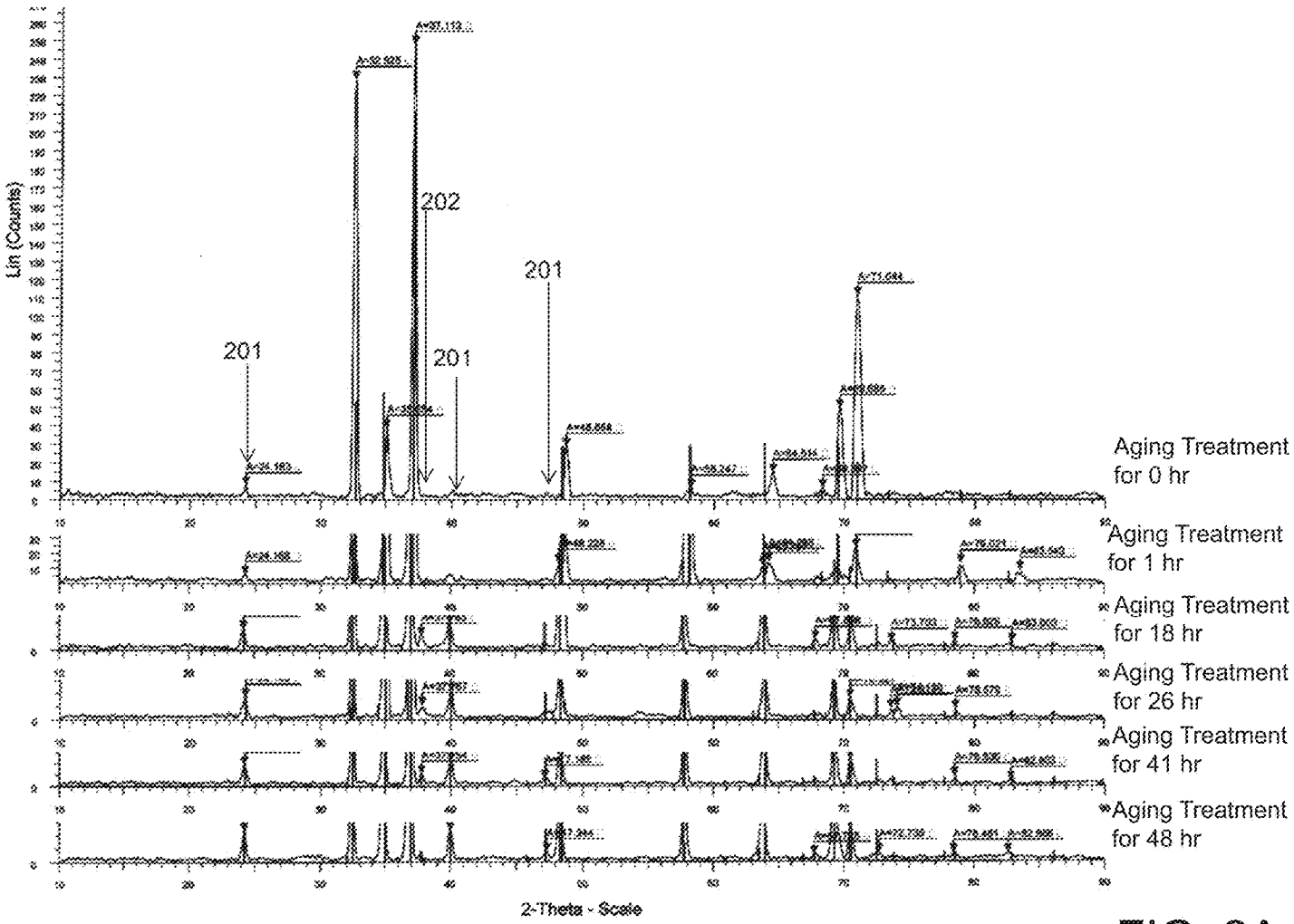
FIGS. 2A-2E show analysis results of ALZ771 processed by a solid solution treatment and an optional aging treatment.
Figure 2B:
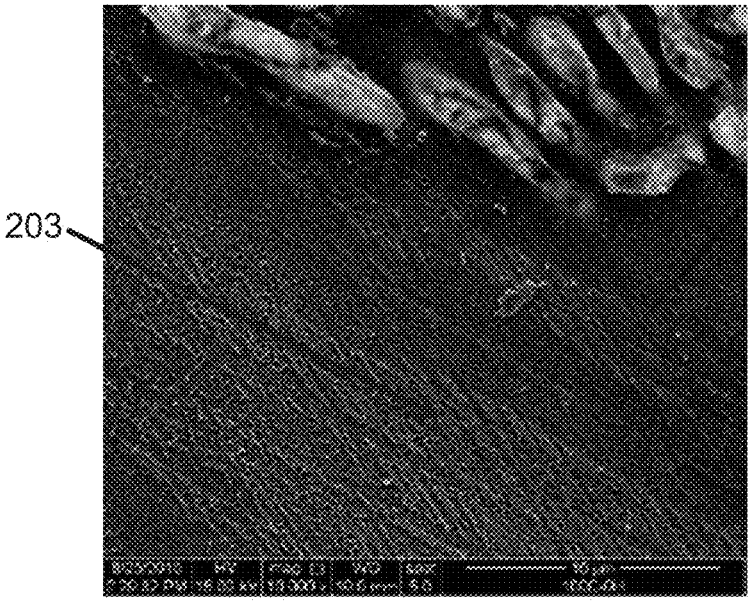
Figure 2C:
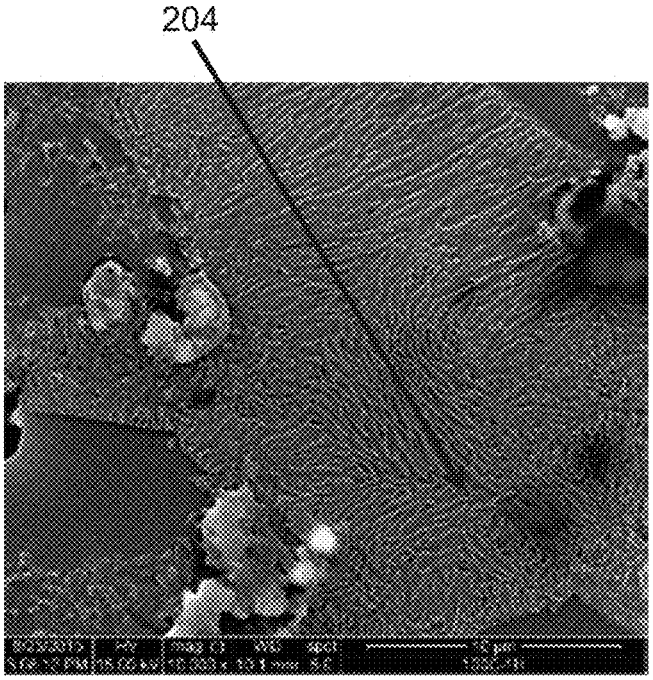
Figure 2D:
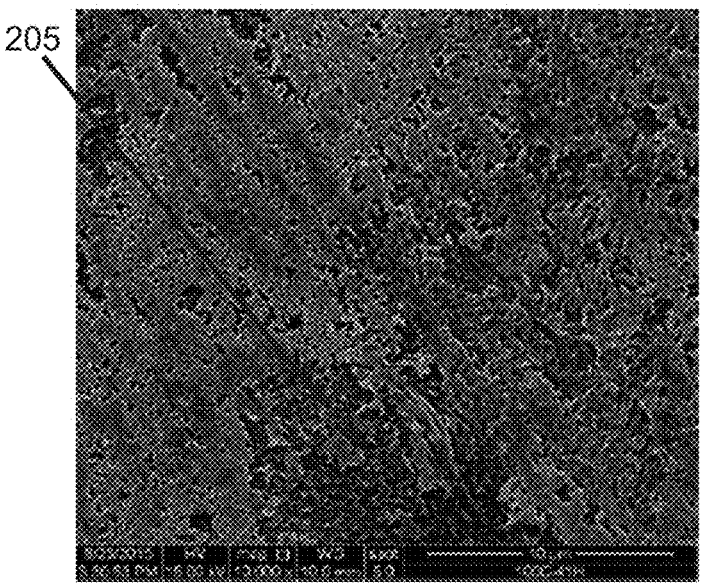
Figure 2E:
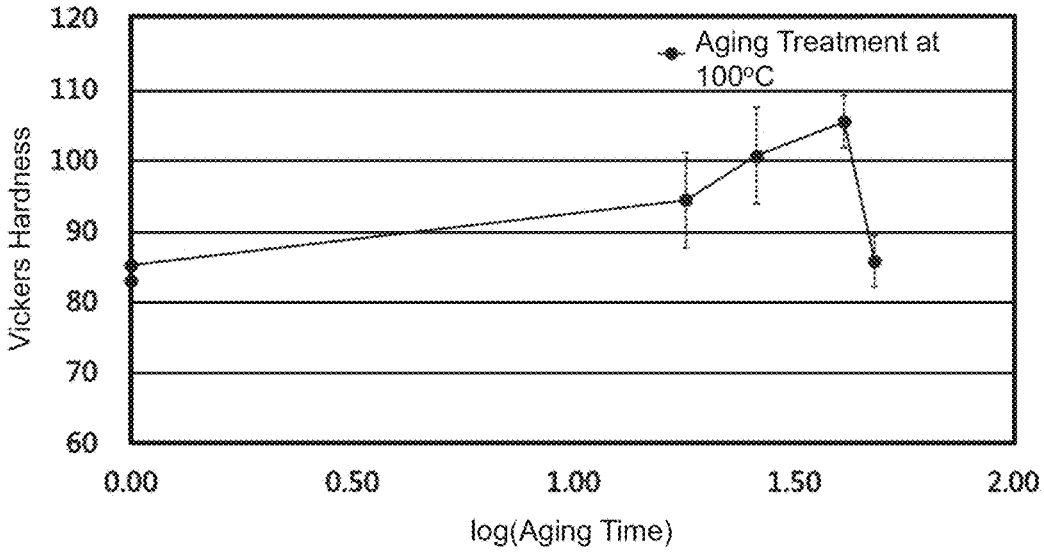

FIGS. 2A-2E show analysis results of ALZ771 processed by a solid solution and an optional aging treatment with various aging time at 100° C. According to the results of X-ray diffraction (XRD, D8, Bruker), as shown in FIG. 2A, the ALZ771 processed by the solid solution and the optional aging treatment with various aging time at 100° C. includes Li—Al phase, as indicated by the arrow 201. ALZ771 also includes $MgLi_2Al$ phase, as indicated by the arrow 202. FIG. 2B shows the microstructure of the ALZ771 after the solid solution treatment, which is observed using a scanning electron microscope (SEM, Inspect F, FEI). It can be seen that the microstructure includes rod structures of Li—Al phase, and the rod structures have a diameter of 15 to 70 nm and a length of 500 to 2,000 nm and are distributed in the α phase, as indicated by the arrow 203. FIG. 2C shows the microstructure of the ALZ771 after the solid solution treatment and the aging treatment at 100° C. for 1 hr, which is observed using the SEM. It can be seen that the microstructure includes rod structures of Li—Al phase, and the rod structures have a diameter of 50 to 150 nm and a length of 1,500 to 3,300 nm and are distributed in the α phase, as indicated by the arrow 204. FIG. 2D shows the microstructure of the ALZ771 after the solid solution treatment and the aging treatment at 100° C. for 41 hr, which is observed using the SEM. It can be seen that the microstructure includes rod structures of Li—Al phase, and the rod structures have a diameter of 100 to 700 nm and a length of 2,500 to 10,000 nm and are distributed in the α phase, as indicated by the arrow 205. FIG. 2E shows the results of Vickers hardness test (Hv hardness, HM-100 Series, Miztoyo). As shown in FIG. 2Em the hardness of ALZ771 can be further increased through a suitable aging treatment. It should be noted that improvement in the hardness of ALZ771 is most significant when ALZ771 is optionally processed with an aging treatment at 100° C. for 41 hr.

Figure 3A:
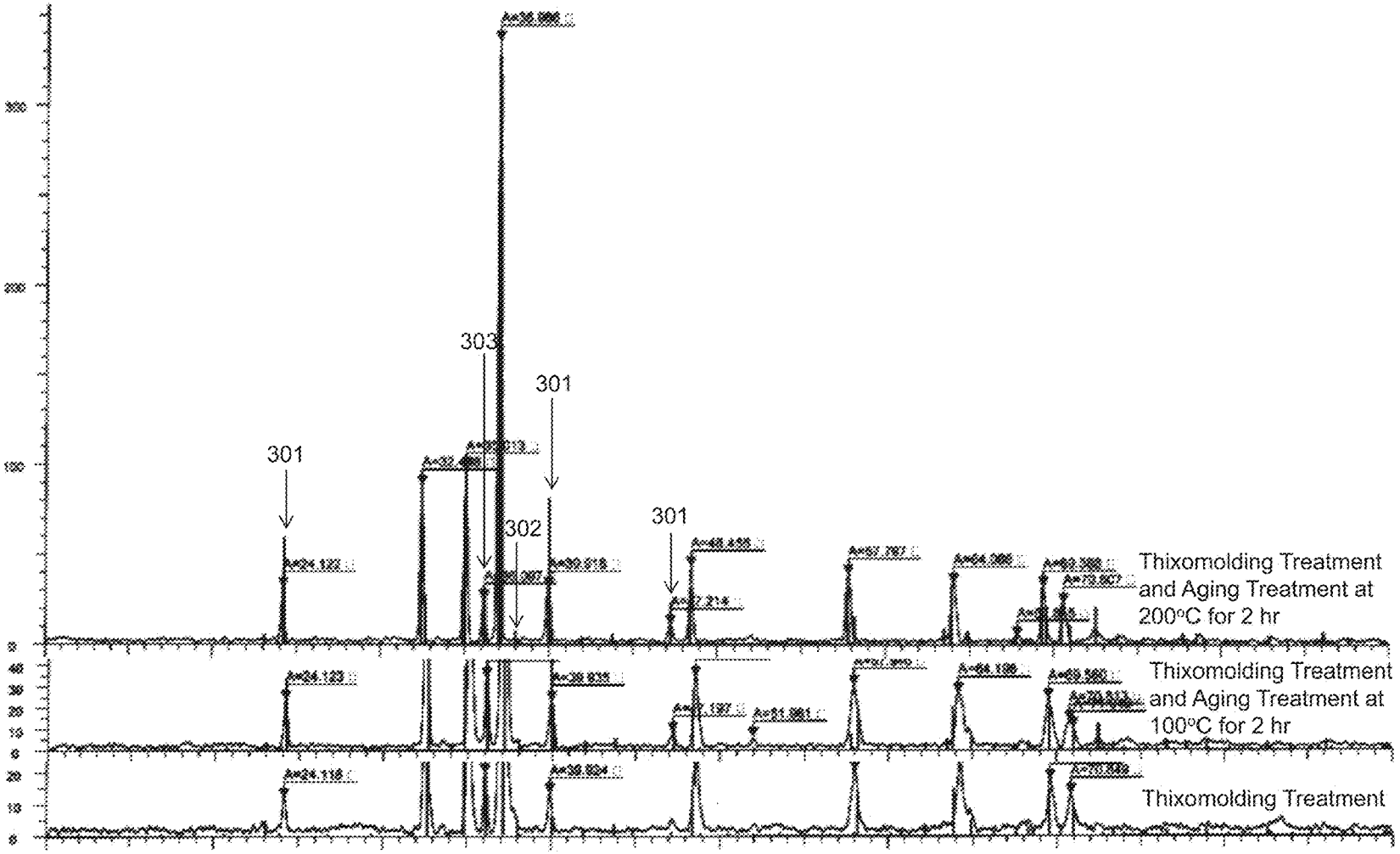
FIGS. 3A-3B show analysis results of ALZ771 processed by a thixomolding treatment and an optional aging treatment.
Figure 3B:
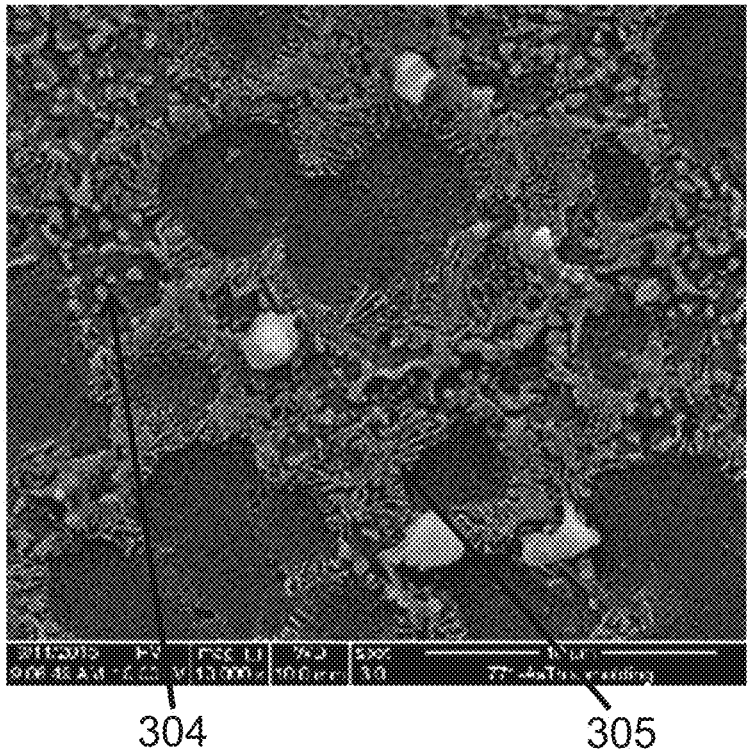

FIGS. 3A-3B show analysis results of ALZ771 processed by a thixomolding solution and an optional aging treatment. According to the results of XRD, as shown in FIG. 3A, the ALZ771 processed by the thixomolding solution and the optional aging treatment includes Li—Al phase, as indicated by the arrow 301. ALZ771 also includes $MgLi_2Al$ phase and $Mg_{17}Al_{12}$ phase, as indicated by the arrows 302 and 303, respectively. FIG. 3B shows the microstructure of the ALZ771 after the thixomolding, which is observed using the SEM. It can be seen that the microstructure includes particle structures of Li—Al phase, and the particle structures have a diameter of 3 to 20 nm, as indicated by the arrow 304. The microstructure also includes rod structures of Li—Al phase, and the rod structures have a diameter of 3 to 15 nm and a length of 60,000 to 150,000 nm, as indicated by the arrow 305. Both of the particle structures and the rod structures are distributed in the α phase. Further, the yield strength is tested using a tensile test. After the thixomolding treatment, the yield strength of ALZ771 is increased from 99.3 MPa, which is measured after the casting step, to 122.2 MPa. The yield strength is also tested using a bending test. After the thixomolding treatment, the yield strength of ALZ771 is increased from 341.7 MPa, which is measured after the casting step, to 361 MPa. That is, forming and/or adjusting the nanoscale reinforcement phase through a thermo-mechanical treatment, such as a thixomolding treatment, can increase the strength of the magnesium alloy.

It will be apparent to those skilled in the art that various modifications and variations can be made to the disclosed embodiments. It is intended that the specification and examples be considered as exemplary only, with a true scope of the disclosure being indicated by the following claims and their equivalents.

What is claimed is:

1. A magnesium alloy, comprising:

magnesium (Mg);

7 wt % of lithium (Li);

7 wt % of aluminum (Al); and 1 wt % of zinc (Zn);

wherein the magnesium alloy has a microstructure which comprises a nanoscale reinforcement phase, and the nanoscale reinforcement phase is a Li—Al compound.

2. The magnesium alloy according to claim 1, wherein the nanoscale reinforcement phase comprises a plurality of particle structures and/or a plurality of rod structures.

3. The magnesium alloy according to claim 2, wherein the particle structures have a diameter of 3 to 900 nm.

4. The magnesium alloy according to claim 2, wherein the particle structures have a diameter of 3 to 500 nm.

5. The magnesium alloy according to claim 2, wherein the particle structures have a diameter of 3 to 20 nm.

6. The magnesium alloy according to claim 2, wherein the rod structures have a diameter of 15 to 70 nm and a length of 0.5 to 2 μm.

7. The magnesium alloy according to claim 2, wherein the rod structures have a diameter of 50 to 150 nm and a length of 1.5 to 3.3 μm.

8. The magnesium alloy according to claim 2, wherein the rod structures have a diameter of 100 to 700 nm and a length of 2.5 to 10 μm.

9. The magnesium alloy according to claim 2, wherein the rod structures have a diameter of 3 to 15 nm and a length of 60 to 150 μm.

10. The magnesium alloy according to claim 1, further comprising at least another nanoscale reinforcement phase selected from a group composed of: a Mg—Li phase, a Mg—Al phase, and a Mg—Li—Al phase.

11. The magnesium alloy according to claim 1, further comprising:

≤0. 3 wt % of manganese (Mn); and

≤0.2 wt % of silicon (Si).

12. A method for manufacturing a magnesium alloy, comprising:

forming a magnesium alloy by casting, wherein the magnesium alloy comprises:

magnesium (Mg);

7 wt % of lithium (Li);

7 wt % of aluminum (Al); and 1 wt % of zinc (Zn); and performing a thermo-mechanical treatment on the magnesium alloy to form a nanoscale reinforcement phase in the magnesium alloy, wherein the nanoscale reinforcement phase is a Li—Al compound.

13. The method according to claim 12, wherein the thermo-mechanical treatment is selected from at least one of: a solid solution treatment, a homogenization treatment, an aging treatment, a T5 heat treatment, a T6 heat treatment, a thixomolding treatment, a semi-solid metal casting treatment, an extrusion treatment, a forging treatment, and a rolling treatment.

14. The method according to claim 12, wherein the thermo-mechanical treatment comprises performing an aging treatment at 30 to 350° C. for 0.1 to 350 hr.

* * * * *